United States Patent [19]

Focke

[11] 4,258,528

[45] Mar. 31, 1981

[54] METHOD AND APPARATUS FOR INTRODUCING GROUPS OF CIGARETTES INTO A PACKET AND FOLDING WRAPPER FLAPS

[75] Inventor: Heinz Focke, Verden, Fed. Rep. of Germany

[73] Assignee: Focke & Co., Verden, Fed. Rep. of Germany

[21] Appl. No.: 19,023

[22] Filed: Mar. 8, 1979

[30] Foreign Application Priority Data

Mar. 11, 1978 [DE] Fed. Rep. of Germany ..... 2810586

[51] Int. Cl.[3] ..... B65B 19/20

[52] U.S. Cl. ..... 53/473; 53/174; 53/202; 53/230; 53/579

[58] Field of Search ..... 53/466, 473, 174, 207, 53/230, 231, 232, 234, 202

[56] References Cited

U.S. PATENT DOCUMENTS

| | | | |
|---|---|---|---|
| 1,336,838 | 4/1920 | Heeter | 53/174 X |
| 1,791,153 | 2/1931 | Aldrich | 53/174 |
| 2,335,750 | 10/1943 | Fincke et al. | 53/202 |
| 2,609,646 | 7/1952 | Total | 53/230 |
| 2,930,173 | 3/1960 | Lapine | 53/230 |
| 2,954,863 | 10/1960 | Staples, Jr. | 198/597 |
| 3,209,514 | 10/1965 | Schmermund | 53/230 |
| 3,301,375 | 1/1967 | Schmermund | 53/148 X |
| 4,084,393 | 4/1978 | Focke | 53/207 X |

FOREIGN PATENT DOCUMENTS

| | | | |
|---|---|---|---|
| 879670 | 6/1953 | Fed. Rep. of Germany | 53/231 |
| 2440006 | 3/1976 | Fed. Rep. of Germany | 53/234 X |

*Primary Examiner*—John Sipos

*Attorney, Agent, or Firm*—Sughrue, Rothwell, Mion, Zinn and Macpeak

[57] ABSTRACT

Two laterally spaced groups of cigarettes 11, 12 partially encased in tinfoil wrappers 27 are discharged from a chain conveyor 26 onto a reciprocating platform 33 by entraining members 24, 25. The groups are then discharged by pushers 42 onto a folding platform 32 until they strike a movable stop 75, at which position three of the four wrapper end flaps are folded and the two groups are laterally brought together. Thereafter the merged groups are fed into the open top or mouth of a packet 10 disposed in a pocket 14 of an indexable turret 15 by pushers 64, which simultaneously fold down the fourth wrapper flap.

15 Claims, 10 Drawing Figures

VII
VII
20
21
22
23
24
25
26
27
28(29)
32
33
34
35
36
37
38
39
41
42
44
45
46
47
48
49
50
51
52
53
54
57
58
59
60
64
69
70
71
72
73
74
76
84
86
87
88
89
90
95
11
12
14
15
16
17
18
19

VII
VII
20
21
22
23
24
25
26
28(29)
28(29)
28(29)
28(29)
11
12
11
12
16
17
18
32
32a
32b
33
34
35
36
37
38
39
41
42
44
45
46
47
48
49
50
51
52
53
54
62
63
64
65
66
67
69
70
71
72
73
74
76
84
88
89

METHOD AND APPARATUS FOR INTRODUCING GROUPS OF CIGARETTES INTO A PACKET AND FOLDING WRAPPER FLAPS

BACKGROUND OF THE INVENTION

The invention relates to a process method and apparatus for introducing articles, encased in an inner wrapper, into an open packet, in particular for introducing a group of cigarettes wrapped in tinfoil into a cigarette packet.

The subject of the invention is the introduction of articles provided with an incompletely folded wrapper into packets. This is particularly relevant to hard packets of cigarettes of various types. The substantially ready-folded packet is held ready, in a filling station, with its orifice pointing towards the arriving group of cigarettes. While the group of cigarettes is being supplied the folding of the tinfoil wrapper, which has end flaps projecting at the rear viewed in the direction of travel, is completed before entry into the packet.

In a known cigarette packaging machine for the production and filling of hard cigarette packets the tinfoil wrapper of the groups of cigarettes is folded while the groups are being transported to the packet. This solution has the advantage that the continuous transport movement of the groups of cigarettes is not interrupted whilst finishing the tinfoil wrapper. However, a disadvantage is that the apparatus has an increased tendency to develop faults because of the complicated folding members. Furthermore, incorrect folding of the tinfoil wrapper cannot be excluded at the high working speed of such packaging machines (German Offenlegungsschrift No. 2,440,006).

SUMMARY OF THE INVENTION

It is the object of the invention further to develop the feed of cigarette groups possessing an inner wrapper to the packet, and to improve these in such a way that in spite of the high output and the high working speed associated therewith, groups of cigarettes with a perfectly folded inner wrapper are introduced into the packet without mechanical or other damage to the cigarettes.

To achieve this object the method according to the invention is characterised in that at least a part of the end flaps of the inner wrapper is folded while the article is momentarily stationary.

According to the invention, a short stop is incorporated into the transport path of the groups of cigarettes, carrying an inner wrapper, to the packet, during which stop the inner wrapper end flaps which project beyond the article at the rear are folded. The momentary interruption of the transport movement takes place on a special folding platform located at a certain distance in front of the open packet. On the folding platform the end flaps are folded by stationary folding members as well as by folding pushers into the plane of the rear end face. The folding pusher simultaneously serves to convey the groups of cigarettes off the folding platform and into the packet.

To fill cigarette packets with two groups of cigarettes (double block packet), the folding platform is so equipped that the groups of cigarettes transported alongside one another but at a distance from one another are brought closely alongside one another, on the folding platform, by a transverse displacement.

A further important characteristic of the invention relates to the articles being taken from an entraining chain conveyor and being transferred to the folding platform. An intermediate conveyor is intended for this purpose; it takes the articles from the conveyor in such a way that a collision of the entraining members of the conveyor, which are led out of the path in which the packets move, with the backwardly projecting end flaps of the inner wrapper is avoided.

DETAILED DESCRIPTION OF THE PREFERRED EMBODIMENTS

Figure 10:
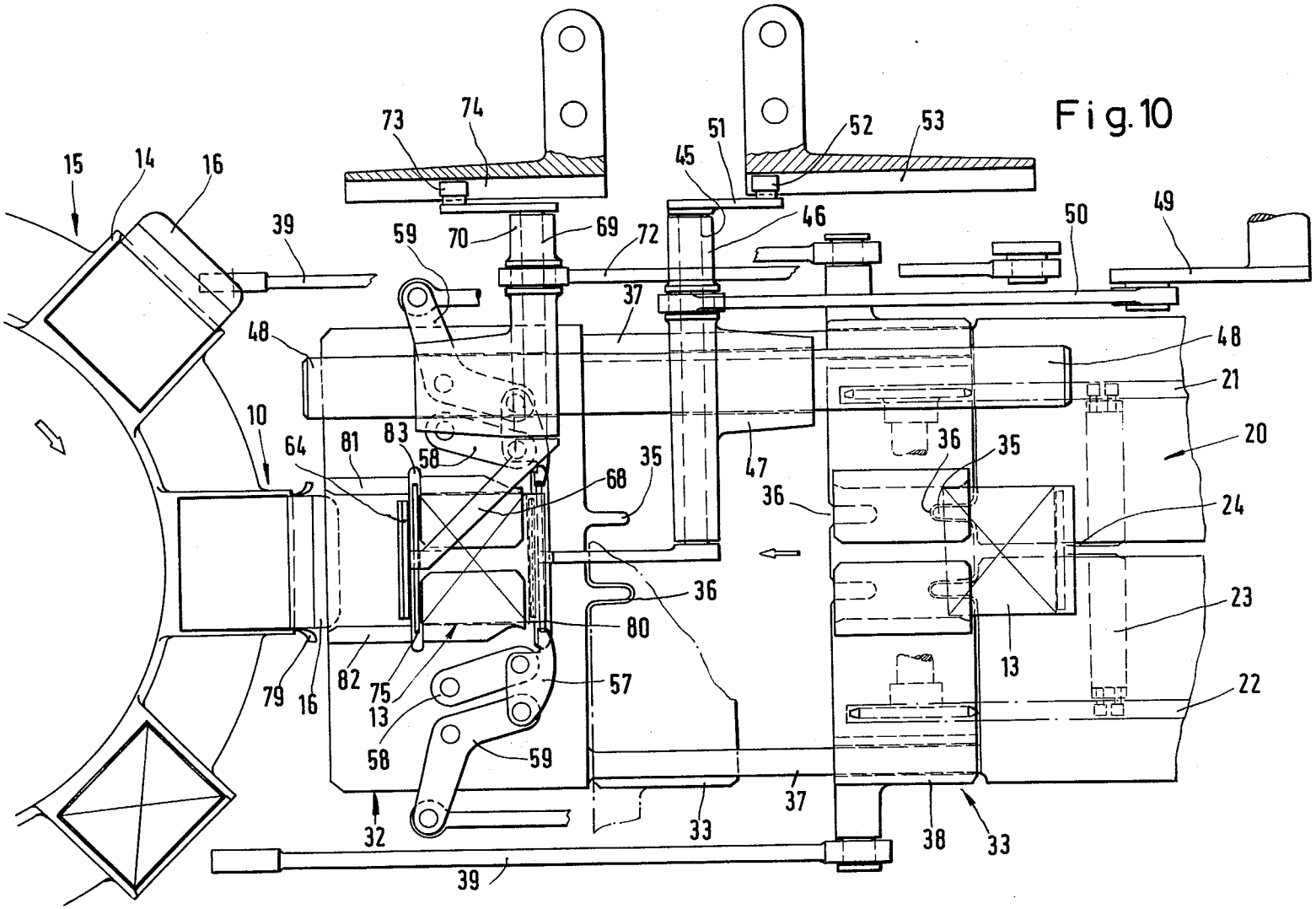
FIG. 10 shows a view similar to FIG. 1 of an embodiment of the apparatus for a single cigarette block.

The illustrative embodiments shown in the drawing concern the filling of cigarette packets 10 by an apparatus of the "pusher and sleeve" type. The apparatus according to FIGS. 1 to 9 is intended for the introduction of two groups of cigarettes 11 and 12 into the cigarette packet 10 (double block packet), while FIG. 10 shows an alternative for a single group of cigarettes 13.

The cigarette packets 10 are received in pockets 14 of a turret 15 which is arranged horizontally to rotate about a vertical axis. The ready-folded, open cigarette packets 10 sit in the pockets 14 in such a way that a closing flap 16 of the slide, on the radially outer side, extends spread-out in the lower plane of the cigarette packet 10. Upright side webs 17 and 18 of the slide are bent sideways for introduction of the cigarette groups 11, 12 or of the cigarette group 13, as will be shown in detail later. The cigarrette groups 11 . . . 13 are fed in the radial direction to the turret 15 or to a cigarette packet 10 in a filling station 19.

The cigarette groups 11, 12 are supplied by a conveyor 20 which runs radially to the turret 15. This conveyor is constructed as a chain conveyor, with two endless conveyor chains 21 and 22. Between these extend transverse supports 23, to each of which are attached, in the example of FIGS. 1 to 9, two entraining members 24 and 25, each for one group of cigarettes, 11 or 12.

The groups of cigarettes 11, 12 are transported on a conveying plate 26 of the conveyor 20 by the entraining members 24, 25. They have beforehand been provided with an inner wrapper, namely a tinfoil wrapper 27, which extends U-shaped from the front of the cigarette group 11, 12, so that rear end flaps project beyond the cigarette group 11, 12. These end flaps are horizontal upper and lower longitudinal end flaps 28, 29 to which adjoin lateral upright side end flaps 30, 31. In the region of the side surfaces, the tinfoil wrapper 27 has already been folded in the stage concerned here. Accordingly, what is involved is completing the tinfoil wrapper 27 by folding the end flaps 28 . . . 31 against the rear end face of the cigarette group 11, 12.

The conveyor 20 ends at a distance from a stationary folding platform 32 arranged transversely to the conveying direction and extending approximately tangentially to the turret 15 and at a distance from the latter. An intermediate conveyor, in the form of a conveying platform 33, which can be subjected to a reciprocating movement, serves to transfer the cigarette groups 11, 12 to the folding platform 32. The cigarette groups 11, 12 are transported by the conveyor 20 onto the conveying platform 33 and are taken over by the latter. The entraining members 24, 25 of the conveyor 20, which engage against the rear end face of the cigarettes within the projecting end flaps 28 . . . 31, are moved out of the path of travel of the cigarette groups 11, 12 by a downward motion, resulting from the conveyor chains 21, 22 being led round sprockets 34. In order that a collision with the backwardly projecting lower longitudinal end flaps 29 shall be avoided, the cigarette groups 11, 12 taken up by the conveying platform 33 are transported off the conveyor 20 at a higher speed than the speed of the entraining members 24, 25. Accordingly, the cigarette groups 11, 12 detach from the entraining members 24, 25 before the latter are led downwards by the sprockets 34.

The conveying platform 33 is a plate extending transversely to the transport direction and adjoining the conveying plate 26, in the plane of the latter, so as to take up the cigarette groups 11, 12. To ensure a continuous transition without misalignment between the rapidly movable conveying platform 33 and the conveying plate 26, they are provided with tongue-like projections 35 and corresponding recesses 36, which in the end position engage positively by one fitting into the other.

In the other, opposite end position, the conveying platform 33 joins flush onto the folding platform 32, which is also constructed as a transverse plate. Here again, projections 35 and recesses 36 are provided.

The conveying plate 26 of the conveyor 20 and the folding platform 32 are connected to one another by slide rods 37 running in the longitudinal direction. The conveying platform 33 is slidingly mounted and guided on these rods by means of corresponding bearing bushes 38. The reciprocating movement of the conveying platform 33 is effected by laterally engaging conveying rods 39, which in turn are driven by a crank 40. On the top face of the conveying platform 33 are provided angular side-bar holders 41, between which the cigarette groups 11, 12 are accommodated.

Figure 1:
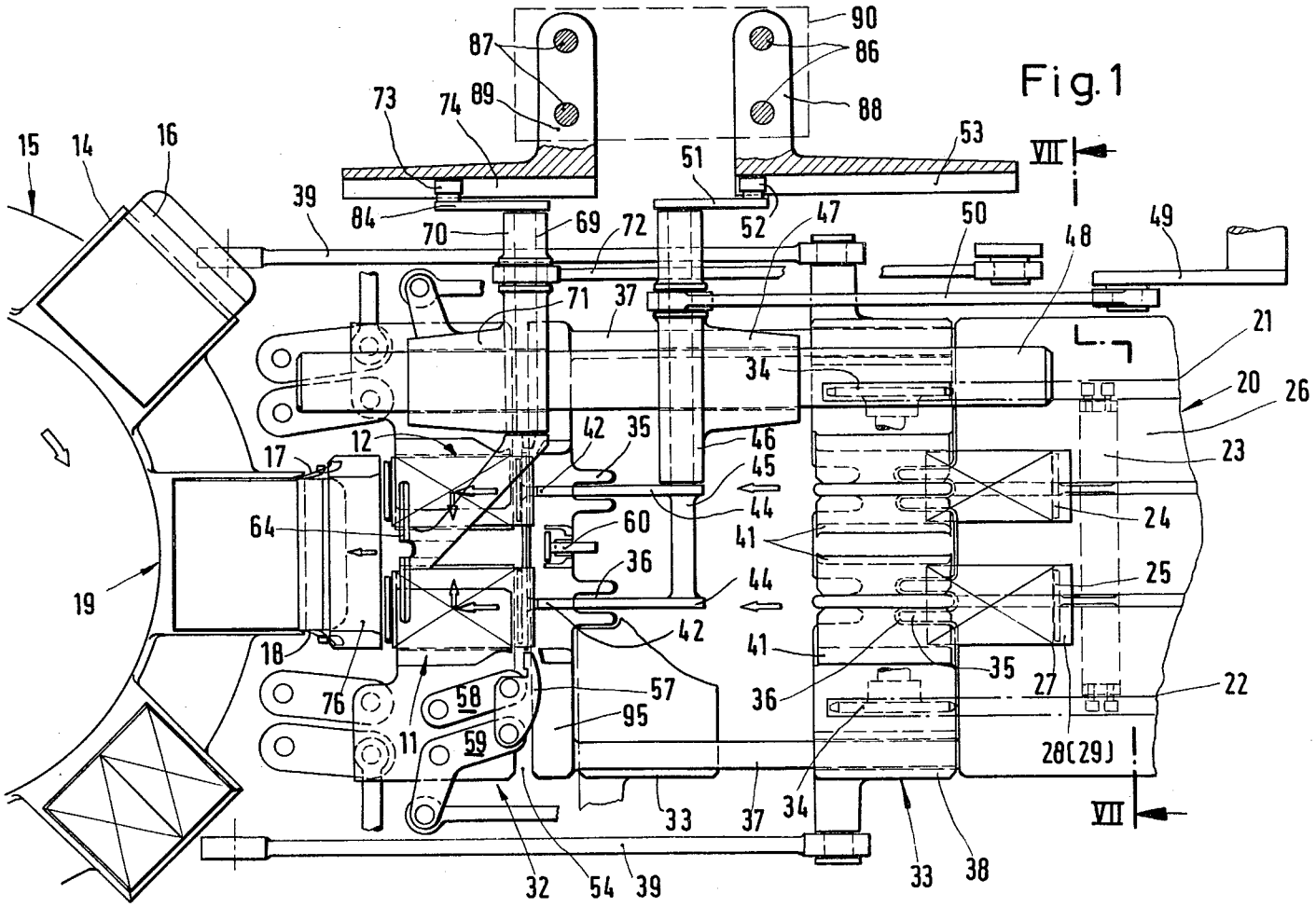
FIG. 1 shows the device for feeding groups of cigarettes to an open packet, in schematic plan view, in an embodiment for filling double block packets.
Figure 2:
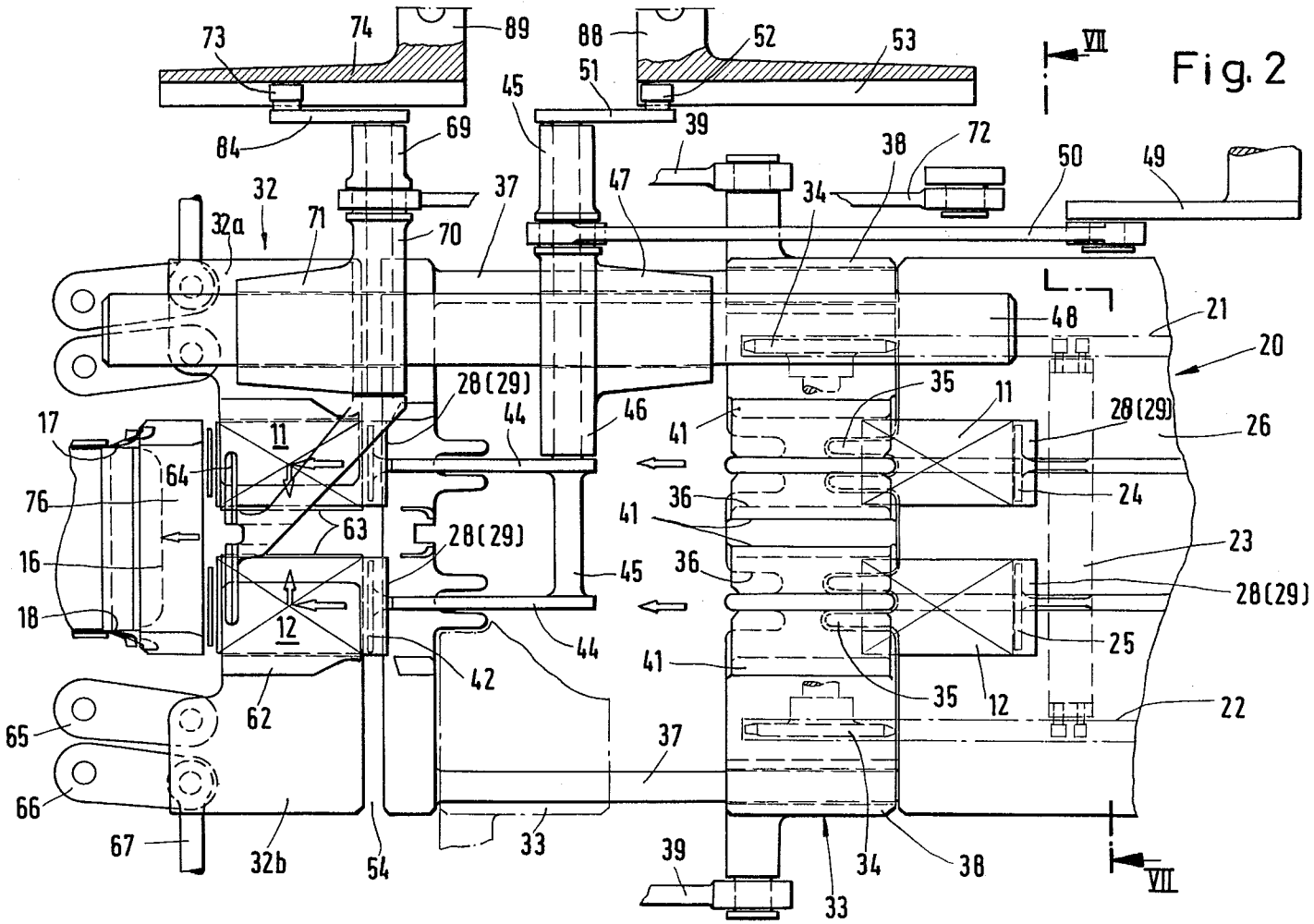
FIG. 2 shows a detail corresponding to FIG. 1, on a slightly enlarged scale.

In the end position facing the folding platform 32, the cigarette groups 11, 12 are pushed by means of pushers 42 off the conveying platform 33 and onto the folding platform 32, and in particular into the folding position according to FIGS. 1, 2 etc. These pushers 42, which are conjointly moved, execute a reciprocating movement in two planes (see movement path 43 in FIG. 6). The pushers 42 and their support arms 44 are, for this purpose, arranged on a common pivoting shaft 45. The latter, in turn, is rotatably mounted in a bearing bush 46. The transversely directed bearing bush 46 is slidingly mounted, via an extension 47, on a rectangular rod 48 running in the longitudinal direction. The reciprocating movements of the pushers 42 are effected by corresponding sliding movement of the bearing bush 46 on the support rod 48. For this purpose, a connecting rod 50, driven by a crank 49, is connected to the bearing bush 46.

The movement path 43, extending in two planes, results from controlled pivoting of the support arms 44 as a result of rotation of the pivoting shaft 45. For this purpose, a bar 51 is attached to the free end of the pivoting shaft 45, which projects from the bearing bush 46, and the bar 51 engages, by a guide roller 52 mounted at its other end, in a rectilinear guide groove 53 of U-shaped cross-section. This groove, in turn, can be raised and lowered synchronously with the longitudinal movement, as will be explained in detail later. The movement path 43, shown in the drawing, of the pushers 42 results from interaction between the movements of the guide groove 53 and the guiding of the bearing bush 46 on the support rod 48.

After the cigarette groups 11, 12 have been laid on the folding platform 32, the rear end flaps 28 . . . 31 are folded while the cigarette groups 11, 12 are momentarily at rest. For this purpose, the folding platform 32 is divided into two zones by a transverse gap 54 extending the full length of the platform. The cigarette groups 11, 12 are conveyed over the gap 54 into the zone of the folding platform 32 which faces the turret 15, in such a way that the backwardly projecting end flaps 28 . . . 31 extend in the zone of the gap 54. Folding members, in each case a folding plate 55, pass from below through the gap 54 in order to fold over the lower longitudinal end flap 29. In addition, the gap 54 serves to delimit a transverse bridge 95, as part of the folding platform 32, from the remainder of the platform, the bridge being stationary and immovable and facing the conveying platform 33.

First, the lateral end flaps 30 and 31 are folded on the folding platform 32, the outer lateral flaps 30 being folded by side folders 56 and 57 located on the folding platform 32.

Figure 3:
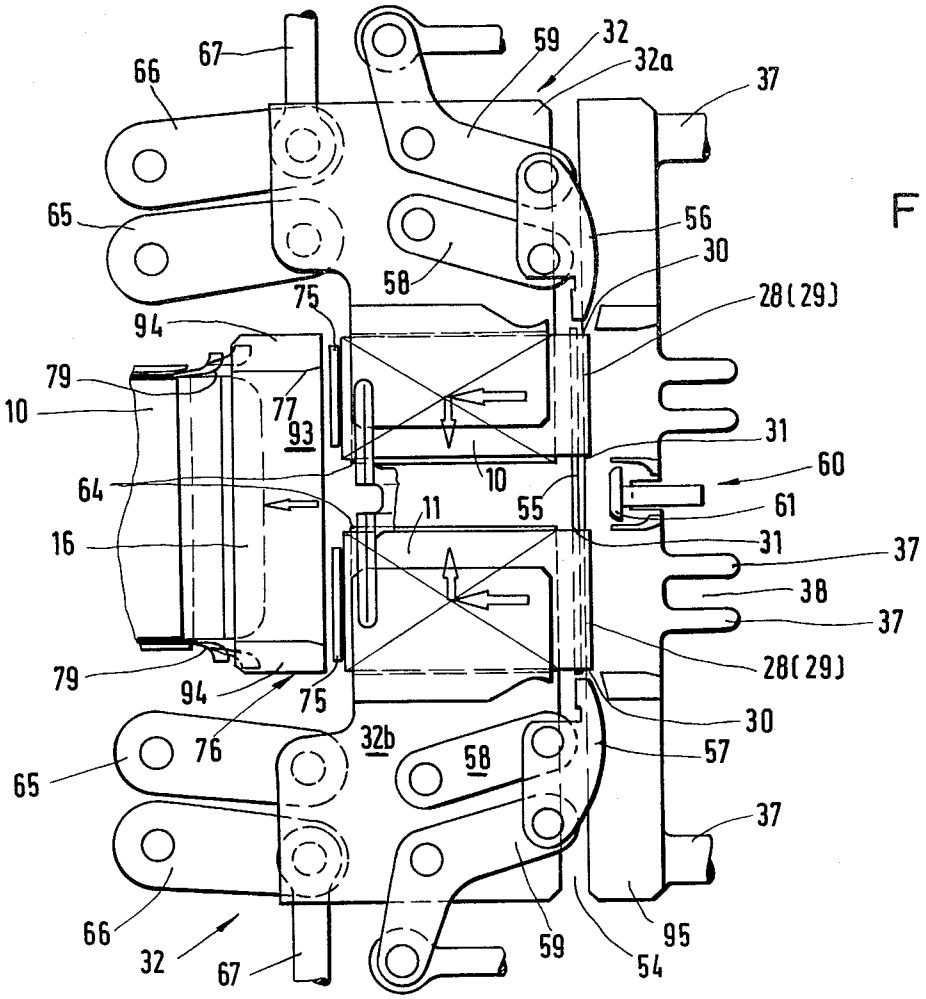
FIG. 3 shows a detail of FIGS. 1 and 2, on a yet further enlarged scale, again in plan view.

For the inner lateral end flaps 31, facing one another, a conjoint central folder 60 is provided . After the cigarette groups 11, 12 have been pushed onto the folding platform 32, this central folder is moved into the plane of their rear end faces. First, the central folder 60 is located in the zone between the cigarette groups 11, 12, which are arranged at a distance from one another (FIG. 3). By bringing the groups together (FIG. 4), the mutually facing lateral end flaps 31 of the cigarette groups 11, 12 are folded over by a folding head 61 of the central folder 60, as a result of the relative movement. The central folder 60 is mounted below the folding platform 32. The two end positions of the central folder 60, and of the folding plate 55, can be seen in FIG. 6.

Figure 4:
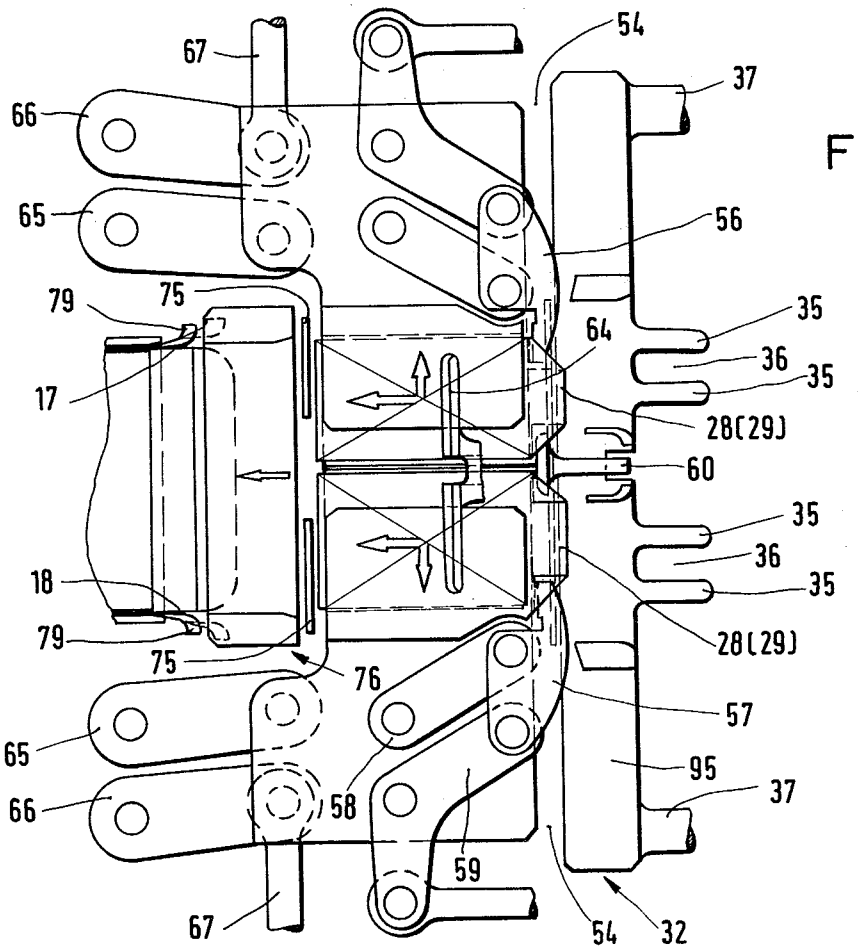
FIG. 4 shows the detail according to FIG. 3, with an altered relative position of the individual folding members and other members.
Figure 5:
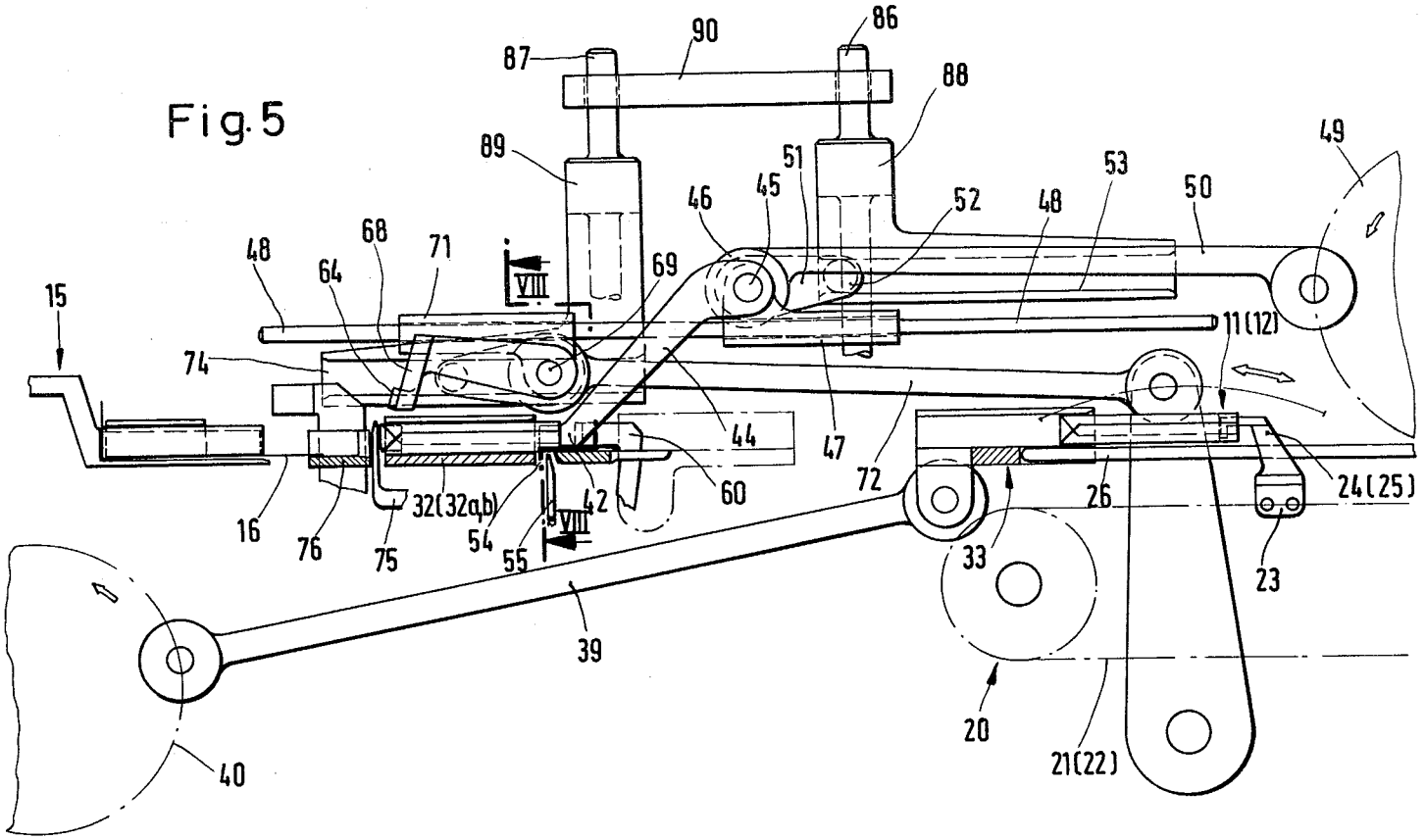
FIG. 5 shows a schematic side view of the apparatus according to FIGS. 1 and 2, partially in longitudinal section.
Figure 6:
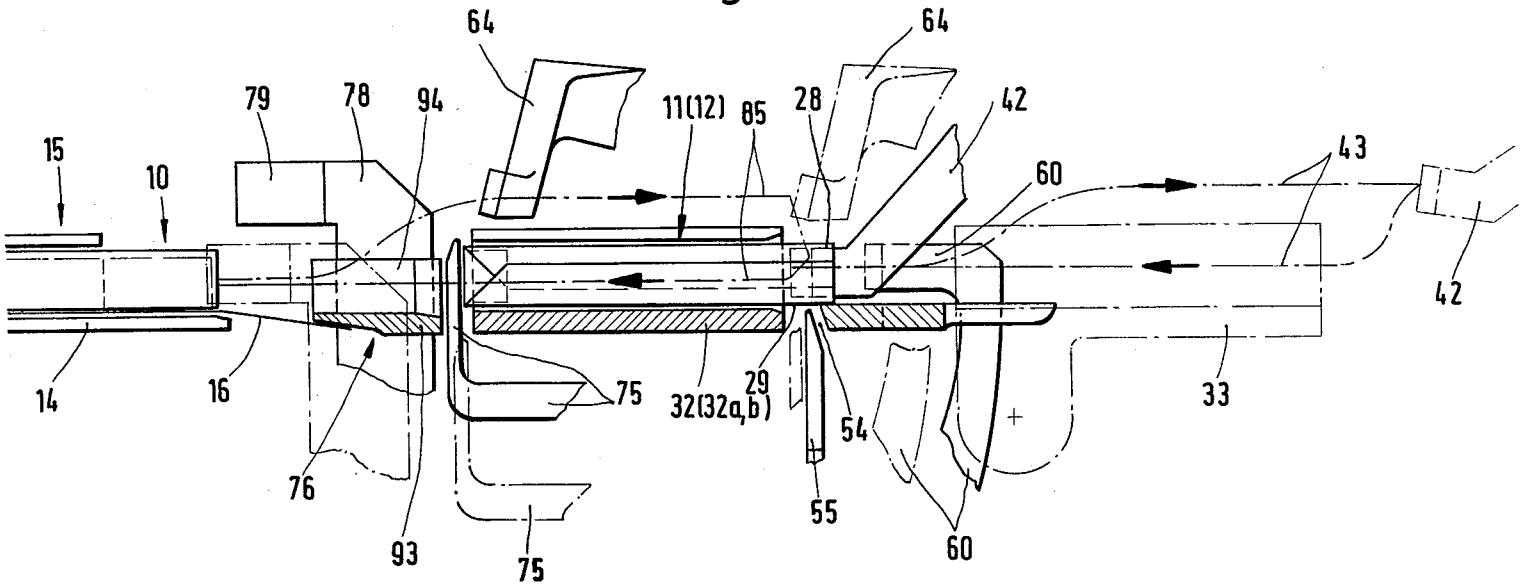
FIG. 6 shows a view similar to FIG. 5, with omission of certain parts of the apparatus, on an enlarged scale.
Figure 7:
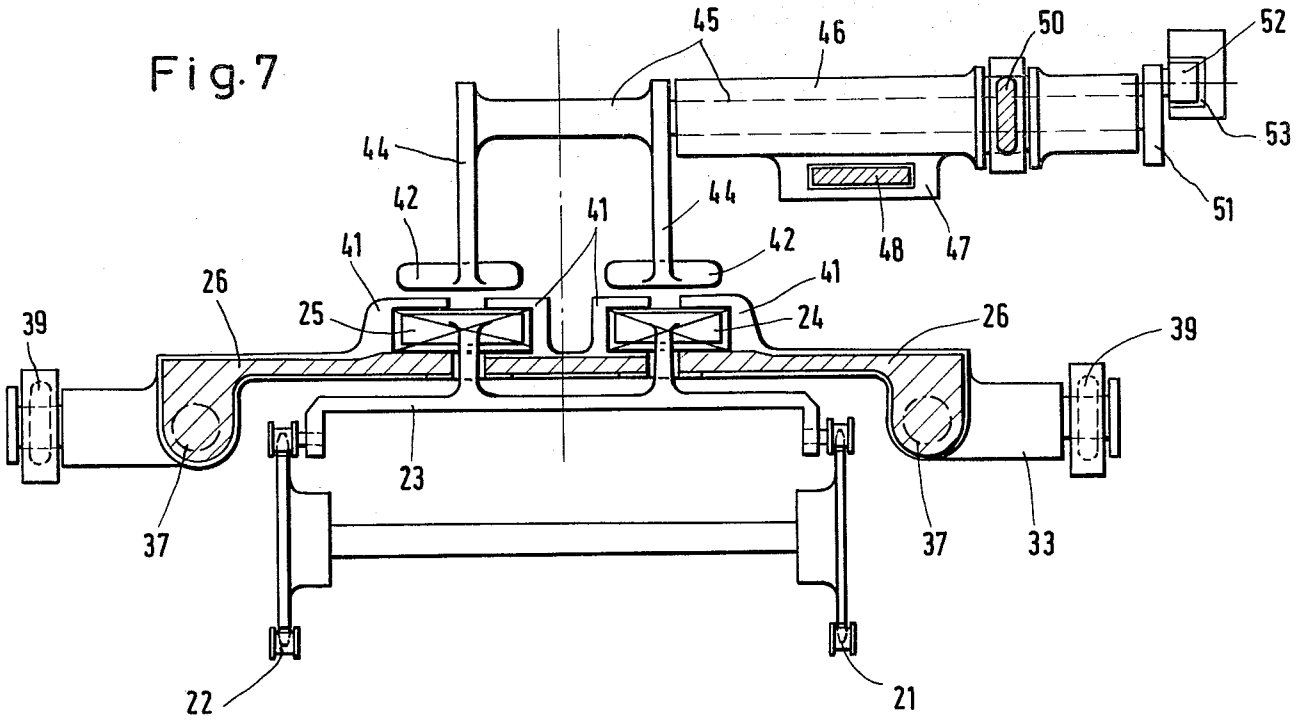
FIG. 7 shows a cross-section in plane VII—VII of FIG. 1, on an enlarged scale.
Figure 8:
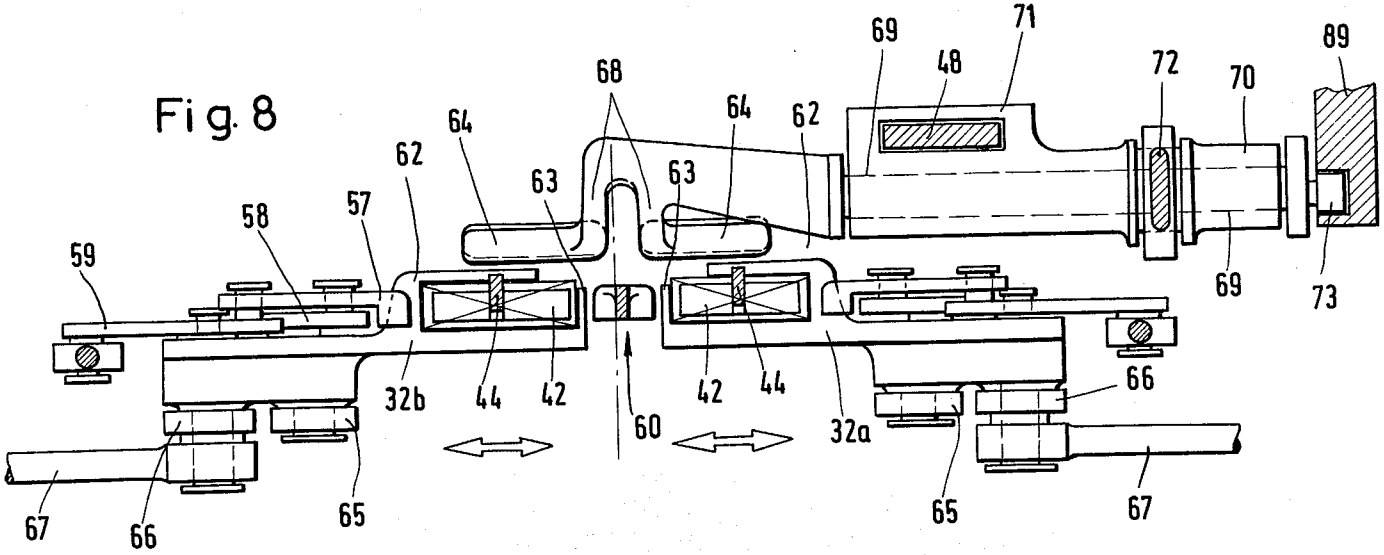
FIG. 8 shows a cross-section VIII—VIII in FIG. 5, on an enlarged scale.
Figure 9:
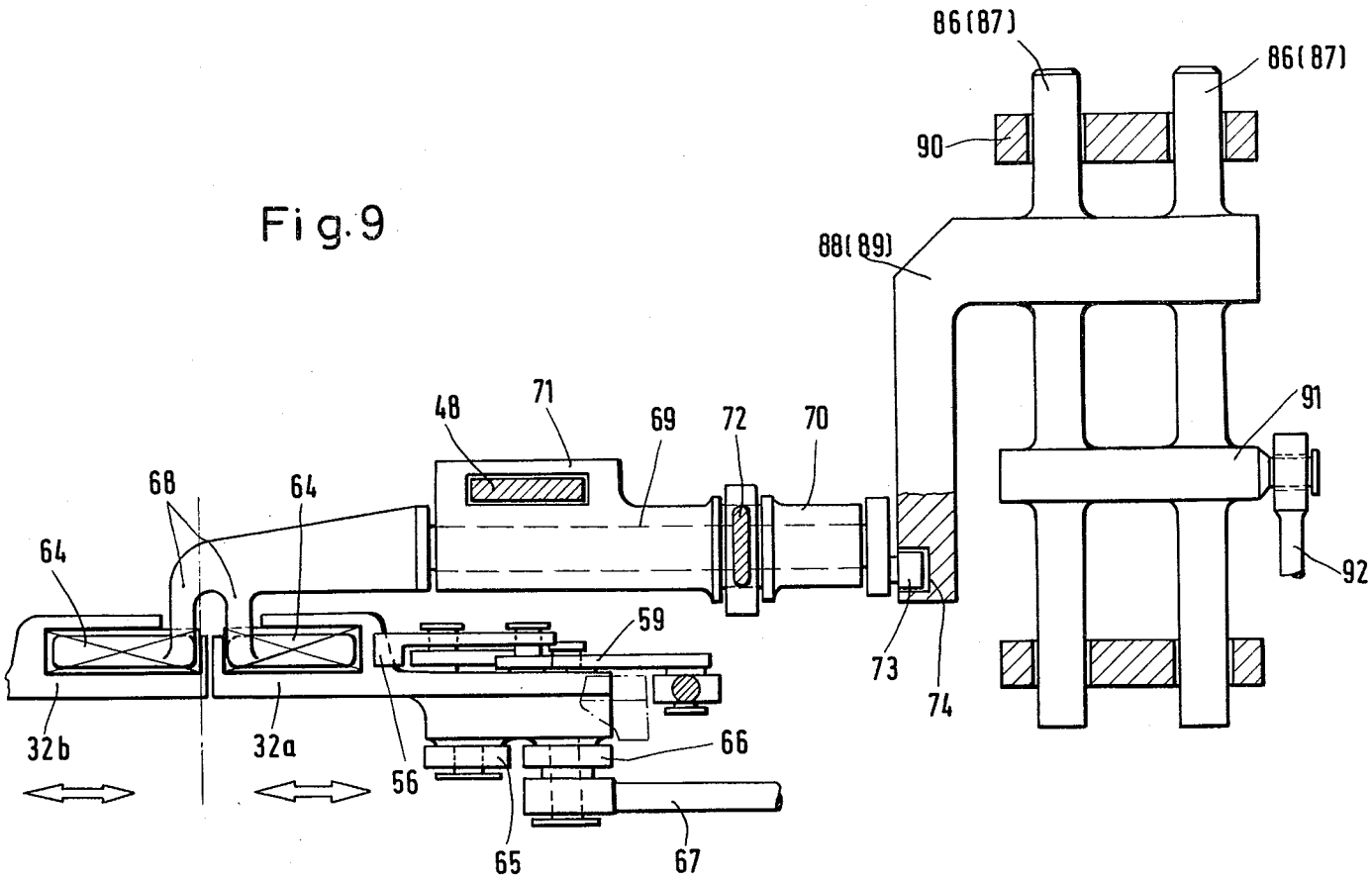
FIG. 9 shows a part of the cross-section according to FIG. 8, with an altered position of the members of the apparatus and with additional details.

In the position according to FIG. 4 after the lateral end flaps 30, 31 have been folded inwards, the folding plate 55 is moved upwards, as a result of which the lower longitudinal end flaps 29 of both cigarette groups 11, 12 are folded against the end face. In the course thereof, the folding plate 55 executes a translatory movement along an arc of a circle.

The final folding over of the upper longitudinal end flaps 28 is effected by folding pushers 64, which at the same time serve to convey the cigarette groups 11, 12 off the folding platform 32 and into the cigarette packet 10 by engaging on their rear face.

In order to bring the cigarette groups 11, 12 together in the transverse direction, the zone of the folding platform 32 which faces the turret 15 is divided into two platform halves 32*a* and 32*b*. Each platform half receives one cigarette group 11, 12. The distance of the platform halves 32*a*, 32*b* from one another approximately corresponds to the distance between the cigarette groups 11, 12. For bringing together, the platform halves 32*a*, 32*b* are moved translatorily towards one another from the position according to FIG. 3 or FIG. 8 into the position according to FIG. 4 or FIG. 9. For this purpose, the platform halves 32*a*, 32*b* are slidable by a rod 67 via parallel connecting plates 65, 66.

The cigarette groups 11, 12 are fixed on the folding platform 32 or the platform halves 32*a*, 32*b* by holders. On either side of each cigarette group 11, 12 are arranged side bars 62, 63, the outer side bars 62 being angular while the mutually facing side bars 63 are merely constructed as upright, thin-walled borders. The platform halves 32*a*, 32*b* are moved towards one another when bringing the cigarette groups 11, 12 together until the side bars 63 make contact.

The folding pushers 64 are driven and controlled in a similar manner to the pushers 42. Support arms 68 are connected to a pivoting shaft 69. The latter is mounted in a bearing bush 70. The bush, in turn, is slidingly seated by means of an extension 71 on the common support rod 48. The unit hitherto described is reciprocatingly driven by a connecting rod 72. To execute the pivoting movements of the support arms 68, the pivoting shaft 69 is pivoted by means of a guide roller 73 which is mounted on a bar 84 connected to the pivoting shaft 69 and runs in a guide groove 74 which can be moved up and down. As a result, the movement path of the folding pushers 64 is similar to that of the pushers 42.

The movement of the folding pushers 64 takes place on a similar movement path 85 as the movement of the pusher 42 (movement path 43). The forward movement takes place in a lower plane and the return movement in a plane above the cigarette groups 11, 12.

The guide grooves 53 and 74, acting as the cooperating control member for the pushers 42 and folding pushers 64, are mounted on a common holder (FIG. 9) but can be moved up and down independently of one another. The holder consists of two upright guide rods 86 and 87. The guide grooves 53 and 74 are firmly attached to these by means of angle-shaped holders 88, 89. The guide rods 86, 87 can be moved up and down independently of one another, so that the angle-shaped holders 88, 89 and hence the guide grooves 53, 74 follow these movements. In the upper zone, the guide rods 86, 87 are slidingly carried in a common connecting plate 90. The lower zones of the guide rods 86 and 87 are connected to a separate cross-member 91 which is moved up and down in a suitable manner by means of a lifter rod 92 synchronously with the longitudinal movement of the pushers 42 or folding pushers 64.

The precise position of the cigarette groups 11, 12 on the folding platform 32 in the conveying direction is determined by a movable stop 75 for each cigarette group 11, 12, on the side facing the turret 15. This stop 75 is in the upper end position in the conveying direction in front of the folding platform 32, so that the cigarette groups 11, 12 run up against this stop 75, which can be moved up and down.

An intermediate bridge 76 is located between the folding platform 32 and the turret 15, or the particular cigarette packet 10 which is to be filled. This bridge consists of a bottom wall 93 and upright side walls 94. On the side at which the cigarette groups 11, 12 enter, the walls of the intermediate bridge 76 are provided with a chamfer 77. This facilitates the entry of the cigarette groups 11, 12 while undergoing a transverse shift until they rest completely tightly against one another.

The relative position of the intermediate bridge 76 is such that the outstretched closing flap 16 of the cigarette packet 10 rests with an outer part-zone thereof under the bottom wall 93 of the intermediate bridge 76. With the stop 75 retracted downwards, the cigarette groups 11, 12 are pushed into the cigarette packet 10 via the intermediate bridge 76.

To ensure that this pushing-in sequence takes place trouble free, lateral guides 78 are provided in this transition zone. These lateral guides 78, which can be raised and lowered, enter the open cigarette packet 10 by means of guide lips 79, in such a way that the side webs 17, 18 are bent slightly outwards. Trouble-free entry of the cigarette groups 11, 12 is now possible. In the raised position of the lateral guide 78, its guide lips 79 have been raised out of the movement path of the cigarette packet 10 so that the packet can, by rotation of the turret 15, be conveyed into and out of the filling station 19.

The finishing or closing of the cigarette packet 10 then takes place in a suitable known manner during the further movement of the turret 15.

FIG. 10 shows an embodiment of the apparatus modified for cigarette packets 10 with a single cigarette group 13.

The principle of construction and the arrangement and execution of individual parts of the apparatus in this case corresponds to the embodiment already described. As a modification, the conveyor 20 is equipped with only one entraining member 24, which centrally transports the individual cigarette group.

Furthermore, the folding platform 32 is constructed as a one-piece platform. Hence, both the sub-division in the transverse direction, to form the platform halves 32*a*, 32*b* which can be moved relative to one another, and the gap 54 which, in the preceding embodiment, extends over the entire width of the folding platform 32, are absent. Instead, in the embodiment of FIG. 10, a slit 80 of limited dimensions is provided. The folding plate 55, for folding-over the lower longitudinal end flap 29, passes through this slit.

Furthermore, an intermediate bridge 76 has been dispensed with in the embodiment of FIG. 10. The folding platform 32 in this case leads up to the turret 15 sufficiently far that the closing flap 16 rests with its outer zone underneath the folding platform 32. Accordingly, the cigarette group 13 is directly pushed by the folding pusher 64 from the folding platform 32 into the cigarette packet 10.

On the folding platform 32 the cigarette group 13 is held by lateral guide walls 81 and 82. These extend up to the end of the folding platform 32 which faces the turret 15. A break, in the shape of a further slit 83, is provided for the passage of the stop 75.

I claim:

1. A method for introducing a pair of objects wrapped in an inner wrapper into an open pack, and in particular for introducing a pair of cigarette groups with a tin foil wrapper into a cigarette pack, comprising:

conveying partially wrapped objects (11,12) in a predetermined direction in a spaced relationship by means of a first conveyor (20), transferring said objects (11,12) to an intermediate conveyor (33) which removes the objects from said first conveyor with a velocity higher than the transport velocity of said first conveyor, transferring said objects to a folding station that is stationary in said predetermined direction and having platform halves extending laterally to said direction and capable of being moved together with each half supporting one object, wherein rearwardly projecting end flaps of said objects are folded during a momentary pause in the movement of said objects, shifting said platform halves laterally to said direction to laterally shift the objects such that side end flaps (30,31) are folded by contacting a folding element during the lateral movement as the objects come into contact with one another, and transferring the objects in said predetermined direction into said open pack.

2. Apparatus for introducing two articles wrapped in an inner wrapper into an open pack, and particularly for introducing two groups of cigarettes with a tin foil wrapper into a cigarette pack, comprising:

a folding station for folding rearwardly projecting end flaps (28,29,30,31) of the inner wrappers of the articles into their final positions during a momentary pause in the movement of the articles, a conveyor (20) having carriers (24,25) for moving the articles in a predetermined direction to said folding station, said carriers engaging the rear surfaces of said articles within the area of the rearwardly projecting end flaps of the inner wrapper thereof, a conveying platform (33) arranged between the folding station and said conveyor (20), means for moving said conveying platform in said direction at a speed higher than the transport velocity of said conveyor after receiving the articles (11,12) from the conveyor (20), a folding platform (32) that is stationary in said predetermined direction and receiving said articles from said conveying platform, said folding platform having platform halves (32*a*, 32*b*), extending laterally to said direction and capable of being moved together, each said half supporting one article, means for moving the platform halves (32*a*, 32*b*) laterally into contact with each other to move the articles, together and fold side end flaps during the lateral movement, and whereby the platform halves are respectively associated with folding members for folding the end flaps (28,29, 30,31) of the inner wrapper (27) during a pause in the movement of said articles, and means for transferring the articles in said predetermined direction into said open pack.

3. Apparatus according to claim 2, further including a central folder (60) for folding confronting side end flaps (31) as the articles are brought together, said central folder being located between said side end flaps (31).

4. Apparatus according to claim 2, wherein the folding members include side folders (56, 57) for the side end flaps (30, 31), a lower folding plate (55) for a first, lower longitudinal end flap (29), and an upper folding pusher (64) for a further, upper longitudinal end flap (28).

5. Apparatus according to claim 4, wherein the side folders (56, 57) are mounted on the folding platform (32).

6. Apparatus according to claims 4 or 5, wherein the side folders (56, 57) are movable translationally along an arc of a circle by means of parallel guides (58, 59).

7. Apparatus according to claim 4, wherein the lower folding plate (55) is located below the folding platform (32) and can be moved upwards at the back thereof to foldover the lower projecting longitudinal end flap (29).

8. Apparatus according to claim 4, wherein the upper folder is constructed as a folding pusher (64) by means of which the articles (11, 12; 13) can be pushed off the folding platform (32) while simultaneously folding-over the upper longitudinal end flap (28).

9. Apparatus according to claim 2, wherein the folding position of the articles (11, 12; 13) on the folding platform (32) is fixed by movable stops (75), which, in the folding position, project into the movement path of the articles (11, 12; 13) before the front limit of the folding platform (32).

10. Apparatus according to claim 3, wherein the central folder (60) can be moved, in the conveying direction of the articles, from a retracted position into the folding position.

11. Apparatus according to claim 2, wherein the articles are pushed onto the conveying platform by entraining members (24, 25) of the conveyor, and are pushed off this platform and onto the folding platform by separate pushers (42).

12. Apparatus according to claim 2, wherein the conveying platform, in its terminal positions, is flush with a conveying plate (26) of the conveyor, and with the folding platform (32).

13. Apparatus according to claim 12, wherein the conveying platform, the conveying plate, and the folding platform are provided with projections (35) and recesses (36) which positively engage with one another.

14. Apparatus according to claim 2, wherein an intermediate bridge (76) is located between the folding platform (32) and the turret (15) at a distance therefrom, over which bridge the articles can be pushed into an open packet.

15. Apparatus according to claim 2, wherein lateral guides (78) which can be moved up and down are provided in the zone between the folding platform (32) and the packet (10) which is to be filled, and engage, in the lowered position, by means of guide lips (79) into the lateral zone of the open packet.

* * * * *